US007355612B2

(12) United States Patent
Damera-Venkata et al.

(10) Patent No.: US 7,355,612 B2
(45) Date of Patent: Apr. 8, 2008

(54) DISPLAYING SPATIALLY OFFSET SUB-FRAMES WITH A DISPLAY DEVICE HAVING A SET OF DEFECTIVE DISPLAY PIXELS

(75) Inventors: Niranjan Damera-Venkata, Mountain View, CA (US); Daniel R. Tretter, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 827 days.

(21) Appl. No.: 10/750,591

(22) Filed: Dec. 31, 2003

(65) Prior Publication Data

US 2005/0147321 A1 Jul. 7, 2005

(51) Int. Cl.
*G09G 5/02* (2006.01)

(52) U.S. Cl. ..... 345/694; 345/589; 345/597; 345/598

(58) Field of Classification Search ..... 345/694, 345/204, 30, 589, 690, 213, 597, 598, 32, 345/56, 635, 63, 31, 214; 382/32, 56, 635, 382/275, 260, 254, 156; 348/745; 349/43; 355/67

See application file for complete search history.

(56) References Cited

U.S. PATENT DOCUMENTS 4,373,784 A 2/1983 Nonomura et al.
4,662,746 A 5/1987 Hornbeck
4,811,003 A 3/1989 Strathman et al.
4,956,619 A 9/1990 Hornbeck
5,061,049 A 10/1991 Hornbeck
5,083,857 A 1/1992 Hornbeck
5,146,356 A 9/1992 Carlson
5,281,960 A * 1/1994 Dwyer, III ..... 345/31
5,317,409 A 5/1994 Macocs
5,386,253 A 1/1995 Fielding
5,490,009 A 2/1996 Venkateswar et al.
5,504,504 A * 4/1996 Markandey et al. ..... 345/214
5,557,353 A 9/1996 Stahl
5,689,283 A 11/1997 Shirochi
5,842,762 A 12/1998 Clarke
5,897,191 A 4/1999 Clarke
5,912,773 A 6/1999 Barnett et al.
5,920,365 A 7/1999 Eriksson (Continued)

FOREIGN PATENT DOCUMENTS

EP 0692728 1/1996

(Continued)

OTHER PUBLICATIONS

Patent Abstracts of Japan—Olympus Optical Co Ltd—vol. 2003 No. 3—May 5, 2003.

(Continued)

*Primary Examiner*—Prabodh Dharia

(57) ABSTRACT

A method of displaying an image with a display device having a set of defective display pixels includes receiving image data for the image. The method includes generating a first sub-frame and a second sub-frame corresponding to the image data. The method includes selecting a first position and a second position spatially offset from the first position, the first and the second positions selected based on positions of the defective display pixels and characteristics of a human visual system. The method includes alternating between displaying the first sub-frame in the first position and displaying the second sub-frame in the second position.

32 Claims, 11 Drawing Sheets

U.S. PATENT DOCUMENTS

| | | | | |
|---|---|---|---|---|
| 5,953,148 | A | 9/1999 | Moseley et al. | |
| 5,978,518 | A | 11/1999 | Oliyide et al. | |
| 6,025,951 | A | 2/2000 | Swart et al. | |
| 6,067,143 | A | 5/2000 | Tomita | |
| 6,075,884 | A * | 6/2000 | Lubin et al. | 382/156 |
| 6,104,375 | A | 8/2000 | Lam | |
| 6,118,584 | A | 9/2000 | Van Berkel et al. | |
| 6,141,039 | A | 10/2000 | Poetsch | |
| 6,184,969 | B1 | 2/2001 | Fergason | |
| 6,219,017 | B1 | 4/2001 | Shimada et al. | |
| 6,239,783 | B1 | 5/2001 | Hill et al. | |
| 6,243,055 | B1 | 6/2001 | Fergason | |
| 6,313,888 | B1 | 11/2001 | Tabata | |
| 6,384,816 | B1 | 5/2002 | Tabata | |
| 6,393,145 | B2 | 5/2002 | Betrisey et al. | |
| 6,447,097 | B1 * | 9/2002 | Folkins et al. | 347/40 |
| 6,456,340 | B1 * | 9/2002 | Margulis | 348/745 |
| 6,501,446 | B1 * | 12/2002 | De Haan et al. | 345/63 |
| 6,522,356 | B1 | 2/2003 | Watanabe | |
| 6,529,640 | B1 * | 3/2003 | Utagawa et al. | 382/284 |
| 6,654,075 | B1 * | 11/2003 | Takeichi et al. | 349/43 |
| 6,657,603 | B1 | 12/2003 | Demetrescu et al. | |
| 6,704,435 | B1 * | 3/2004 | Imaino et al. | 382/108 |
| 6,736,321 | B2 * | 5/2004 | Tsikos et al. | 235/462.14 |
| 6,862,372 | B2 * | 3/2005 | Yang et al. | 382/254 |
| 6,963,319 | B2 * | 11/2005 | Pate et al. | 345/30 |
| 7,034,811 | B2 * | 4/2006 | Allen | 345/204 |
| 7,182,463 | B2 * | 2/2007 | Conner et al. | 353/31 |
| 2003/0020809 | A1 | 1/2003 | Gibbon et al. | |
| 2003/0076325 | A1 | 4/2003 | Thrasher | |
| 2003/0090597 | A1 | 5/2003 | Katoh et al. | |
| 2003/0123747 | A1 * | 7/2003 | Yang et al. | 382/254 |
| 2004/0027313 | A1 * | 2/2004 | Pate et al. | 345/30 |
| 2004/0027363 | A1 * | 2/2004 | Allen | 345/698 |
| 2004/0263497 | A1 * | 12/2004 | Leroux et al. | 345/204 |
| 2004/0263502 | A1 * | 12/2004 | Dallas et al. | 345/204 |
| 2004/0263818 | A1 * | 12/2004 | Kluter et al. | 355/67 |
| 2005/0078056 | A1 * | 4/2005 | Childers | 345/32 |
| 2005/0134805 | A1 * | 6/2005 | Conner et al. | 353/46 |
| 2005/0225732 | A1 * | 10/2005 | Conner et al. | 353/31 |
| 2006/0082567 | A1 * | 4/2006 | Allen | 345/204 |
| 2006/0092151 | A1 * | 5/2006 | Allen | 345/204 |
| 2007/0091274 | A1 * | 4/2007 | Conner et al. | 353/31 |

FOREIGN PATENT DOCUMENTS

| | | |
|---|---|---|
| EP | 0790514 | 8/1997 |
| EP | 1001306 A2 | 5/2000 |
| EP | 1388839 | 2/2004 |
| EP | 1388840 | 2/2004 |

OTHER PUBLICATIONS

L.M. Chen and S. Hasagawa, "Visual Resolution Limits for Color Matrix Displays", Displays, Technologies, and Applications, vol. 13, pp. 221-226, 1992.

A. Yasuda et al., "FLC Wobbling for High-Resolution Projectors", Journal of the SID May 3, 1997, pp. 299-305.

T. Tokita et al., "P-108: FLC Resolution-Enhancing Device for Projection Displays", SID 02 Digest 2002, pp. 638-641.

L.M. Chen "One-Panel Projectors", pp. 221-226, date unknown.

Candice H. Brown Elliot et al., "Color Subpixel Rendering Projectors and Flat Panel Displays"; SMPTE Advanced Motion Imaging Conference; Feb. 27-Mar. 1, 2003; pp. 1-4.

D.H. Kelly, "Motion and Vision—II. Stabilized Spatio- Temporal Threshold Surface," Journal of the Optical Society of America, vol. 69, No. 10, Oct. 1979.

* cited by examiner

DISPLAYING SPATIALLY OFFSET SUB-FRAMES WITH A DISPLAY DEVICE HAVING A SET OF DEFECTIVE DISPLAY PIXELS

CROSS-REFERENCE TO RELATED APPLICATIONS

This application is related to U.S. patent application Ser. No. 10/213,555, filed on Aug. 7, 2002, entitled IMAGE DISPLAY SYSTEM AND METHOD; U.S. patent application Ser. No. 10/242,195, filed on Sep. 11, 2002, entitled IMAGE DISPLAY SYSTEM AND METHOD; U.S. patent application Ser. No. 10/242,545, filed on Sep. 11, 2002, entitled IMAGE DISPLAY SYSTEM AND METHOD; U.S. patent application Ser. No. 10/631,681, filed Jul. 31, 2003, entitled GENERATING AND DISPLAYING SPATIALLY OFFSET SUB-FRAMES; U.S. patent application Ser. No. 10/632,042, filed Jul. 31, 2003, entitled GENERATING AND DISPLAYING SPATIALLY OFFSET SUB-FRAMES; U.S. patent application Ser. No. 10/672,845, filed Sep. 26, 2003, entitled GENERATING AND DISPLAYING SPATIALLY OFFSET SUB-FRAMES; U.S. patent application Ser. No. 10/672,544, filed Sep. 26, 2003, entitled GENERATING AND DISPLAYING SPATIALLY OFFSET SUB-FRAMES; U.S. patent application Ser. No. 10/697,605, filed Oct. 30, 2003, and entitled GENERATING AND DISPLAYING SPATIALLY OFFSET SUB-FRAMES ON A DIAMOND GRID; U.S. patent application Ser. No. 10/696,888, filed Oct. 30, 2003, and entitled GENERATING AND DISPLAYING SPATIALLY OFFSET SUB-FRAMES ON DIFFERENT TYPES OF GRIDS; and U.S. patent application Ser. No. 10/697,830, filed Oct. 30, 2003, and entitled IMAGE DISPLAY SYSTEM AND METHOD. Each of the above U.S. patent applications is assigned to the assignee of the present invention, and is hereby incorporated by reference herein.

THE FIELD OF THE INVENTION

The present invention generally relates to display systems, and more particularly to displaying spatially offset sub-frames with a display device having a set of defective display pixels.

BACKGROUND OF THE INVENTION

A conventional system or device for displaying an image, such as a display, projector, or other imaging system, produces a displayed image by addressing an array of individual picture elements or pixels arranged in a pattern, such as in horizontal rows and vertical columns, a diamond grid, or other pattern.

Unfortunately, if one or more of the pixels of the display device is defective, the displayed image will replicate the defect. For example, if a pixel of the display device exhibits only an "ON" position, the pixel may produce a solid white square in the displayed image. In addition, if a pixel of the display device exhibits only an "OFF" position, the pixel may produce a solid black square in the displayed image. Thus, the effect of the defective pixel or pixels of the display device may be readily visible in the displayed image.

SUMMARY OF THE INVENTION

One form of the present invention provides a method of displaying an image with a display device having a set of defective display pixels. The method includes receiving image data for the image. The method includes generating a first sub-frame and a second sub-frame corresponding to the image data. The method includes selecting a first position and a second position spatially offset from the first position, the first and the second positions selected based on positions of the defective display pixels and characteristics of a human visual system. The method includes alternating between displaying the first sub-frame in the first position and displaying the second sub-frame in the second position.

DESCRIPTION OF THE PREFERRED EMBODIMENTS

In the following detailed description of the preferred embodiments, reference is made to the accompanying drawings, which form a part hereof, and in which is shown by way of illustration specific embodiments in which the invention may be practiced. It is to be understood that other embodiments may be utilized and structural or logical changes may be made without departing from the scope of the present invention. The following detailed description, therefore, is not to be taken in a limiting sense, and the scope of the present invention is defined by the appended claims.

I. Spatial and Temporal Shifting of Sub-frames

Some display systems, such as some digital light projectors, may not have sufficient resolution to display some high resolution images. Such systems can be configured to give the appearance to the human eye of higher resolution images by displaying spatially and temporally shifted lower resolution images. The lower resolution images are referred to as sub-frames. Appropriate values for the sub-frames are determined so that the displayed sub-frames are close in appearance to how the high-resolution image from which the sub-frames were derived would appear if directly displayed.

One embodiment of a display system that provides the appearance of enhanced resolution through temporal and spatial shifting of sub-frames is described in the above-cited U.S. patent applications, and is summarized below with reference to FIGS. 1-4E.

Figure 1:
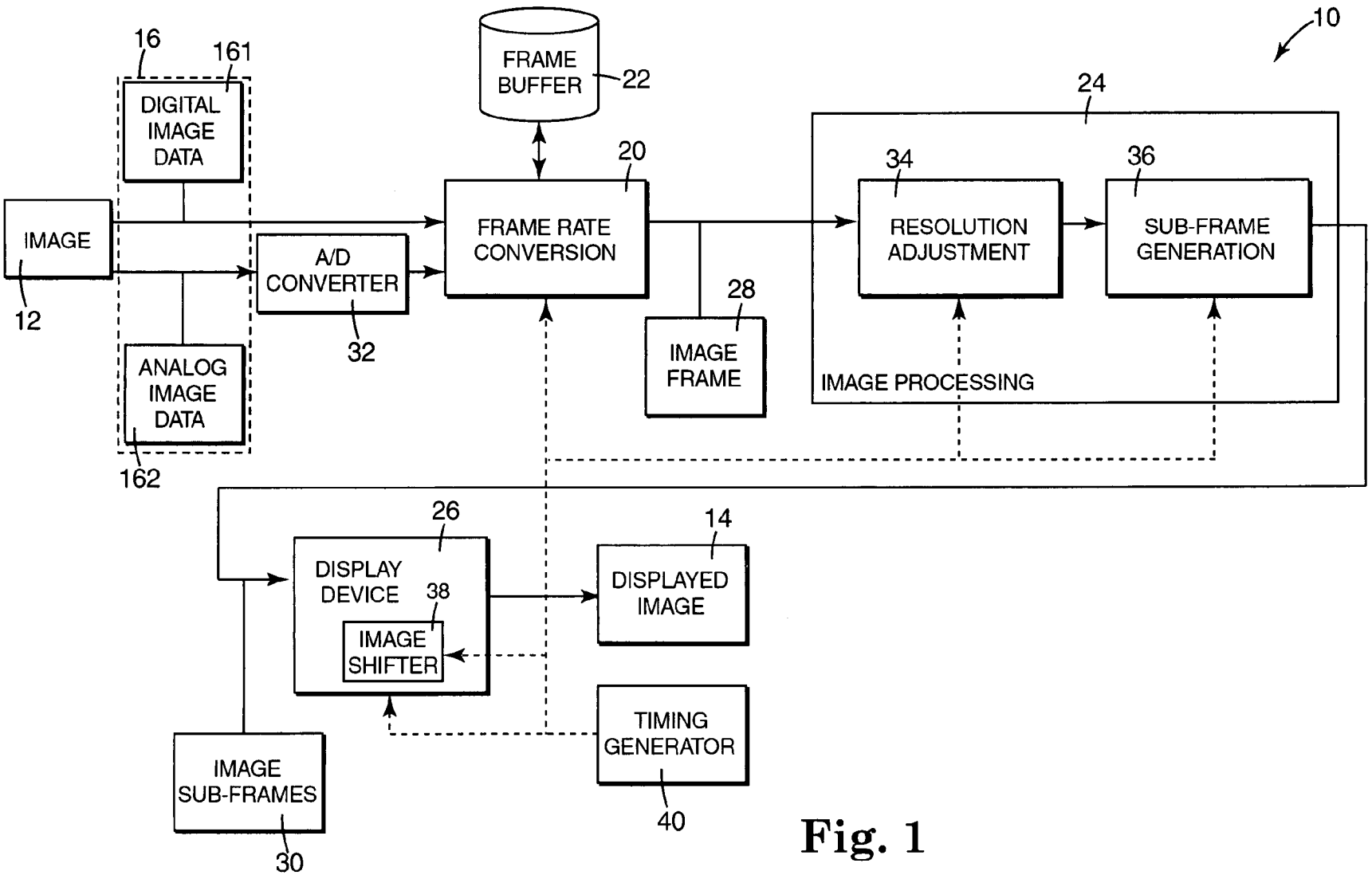
FIG. 1 is a block diagram illustrating an image display system according to one embodiment of the present invention.

FIG. 1 is a block diagram illustrating an image display system 10 according to one embodiment of the present invention. Image display system 10 facilitates processing of an image 12 to create a displayed image 14. Image 12 is defined to include any pictorial, graphical, or textural characters, symbols, illustrations, or other representation of information. Image 12 is represented, for example, by image data 16. Image data 16 includes individual picture elements or pixels of image 12. While one image is illustrated and described as being processed by image display system 10, it is understood that a plurality or series of images may be processed and displayed by image display system 10.

In one embodiment, image display system 10 includes a frame rate conversion unit 20 and an image frame buffer 22, an image processing unit 24, and a display device 26. As described below, frame rate conversion unit 20 and image frame buffer 22 receive and buffer image data 16 for image 12 to create an image frame 28 for image 12. Image processing unit 24 processes image frame 28 to define one or more image sub-frames 30 for image frame 28, and display device 26 temporally and spatially displays image sub-frames 30 to produce displayed image 14.

Image display system 10, including frame rate conversion unit 20 and image processing unit 24, includes hardware, software, firmware, or a combination of these. In one embodiment, one or more components of image display system 10, including frame rate conversion unit 20 and image processing unit 24, are included in a computer, computer server, or other microprocessor-based system capable of performing a sequence of logic operations. In addition, processing can be distributed throughout the system with individual portions being implemented in separate system components.

Image data 16 may include digital image data 161 or analog image data 162. To process analog image data 162, image display system 10 includes an analog-to-digital (A/D) converter 32. As such, A/D converter 32 converts analog image data 162 to digital form for subsequent processing. Thus, image display system 10 may receive and process digital image data 161 or analog image data 162 for image 12.

Frame rate conversion unit 20 receives image data 16 for image 12 and buffers or stores image data 16 in image frame buffer 22. More specifically, frame rate conversion unit 20 receives image data 16 representing individual lines or fields of image 12 and buffers image data 16 in image frame buffer 22 to create image frame 28 for image 12. Image frame buffer 22 buffers image data 16 by receiving and storing all of the image data for image frame 28, and frame rate conversion unit 20 creates image frame 28 by subsequently retrieving or extracting all of the image data for image frame 28 from image frame buffer 22. As such, image frame 28 is defined to include a plurality of individual lines or fields of image data 16 representing an entirety of image 12. In one embodiment, image frame 28 includes a plurality of columns and a plurality of rows of individual pixels on a rectangular grid representing image 12.

Frame rate conversion unit 20 and image frame buffer 22 can receive and process image data 16 as progressive image data or interlaced image data. With progressive image data, frame rate conversion unit 20 and image frame buffer 22 receive and store sequential fields of image data 16 for image 12. Thus, frame rate conversion unit 20 creates image frame 28 by retrieving the sequential fields of image data 16 for image 12. With interlaced image data, frame rate conversion unit 20 and image frame buffer 22 receive and store odd fields and even fields of image data 16 for image 12. For example, all of the odd fields of image data 16 are received and stored and all of the even fields of image data 16 are received and stored. As such, frame rate conversion unit 20 de-interlaces image data 16 and creates image frame 28 by retrieving the odd and even fields of image data 16 for image 12.

Image frame buffer 22 includes memory for storing image data 16 for one or more image frames 28 of respective images 12. Thus, image frame buffer 22 constitutes a database of one or more image frames 28. Examples of image frame buffer 22 include non-volatile memory (e.g., a hard disk drive or other persistent storage device) and may include volatile memory (e.g., random access memory (RAM)).

By receiving image data 16 at frame rate conversion unit 20 and buffering image data 16 with image frame buffer 22, input timing of image data 16 can be decoupled from a timing requirement of display device 26. More specifically, since image data 16 for image frame 28 is received and stored by image frame buffer 22, image data 16 can be received as input at any rate. As such, the frame rate of image frame 28 can be converted to the timing requirement of display device 26. Thus, image data 16 for image frame 28 can be extracted from image frame buffer 22 at a frame rate of display device 26.

In one embodiment, image processing unit 24 includes a resolution adjustment unit 34 and a sub-frame generation unit 36. As described below, resolution adjustment unit 34 receives image data 16 for image frame 28 and adjusts a resolution of image data 16 for display on display device 26, and sub-frame generation unit 36 generates a plurality of image sub-frames 30 for image frame 28. More specifically, image processing unit 24 receives image data 16 for image frame 28 at an original resolution and processes image data 16 to increase, decrease, or leave unaltered the resolution of image data 16. Accordingly, with image processing unit 24, image display system 10 can receive and display image data 16 of varying resolutions.

Sub-frame generation unit 36 receives and processes image data 16 for image frame 28 to define a plurality of image sub-frames 30 for image frame 28. If resolution adjustment unit 34 has adjusted the resolution of image data 16, sub-frame generation unit 36 receives image data 16 at the adjusted resolution. The adjusted resolution of image data 16 may be increased, decreased, or the same as the original resolution of image data 16 for image frame 28.

Sub-frame generation unit 36 generates image sub-frames 30 with a resolution which matches the resolution of display device 26. Image sub-frames 30 are each of an area equal to image frame 28. In one embodiment, sub-frames 30 each include a plurality of columns and a plurality of rows of individual pixels on a rectangular grid representing a subset of image data 16 of image 12.

Image sub-frames 30 are spatially offset from each other when displayed. In one embodiment, image sub-frames 30 are offset from each other by a vertical distance and a horizontal distance, as described below.

Display device 26 receives image sub-frames 30 from image processing unit 24 and sequentially displays image sub-frames 30 to create displayed image 14. More specifically, as image sub-frames 30 are spatially offset from each other, display device 26 displays image sub-frames 30 in different positions according to the spatial offset of image sub-frames 30, as described below. As such, display device 26 alternates between displaying image sub-frames 30 for image frame 28 to create displayed image 14. Accordingly, display device 26 displays an entire sub-frame 30 for image frame 28 at one time.

In one embodiment, display device 26 performs one cycle of displaying image sub-frames 30 for each image frame 28. Display device 26 displays image sub-frames 30 so as to be spatially and temporally offset from each other. In one embodiment, display device 26 optically steers image sub-frames 30 to create displayed image 14. As such, individual pixels of display device 26 are addressed to multiple locations.

In one embodiment, display device 26 includes an image shifter 38. Image shifter 38 spatially alters or offsets the position of image sub-frames 30 as displayed by display device 26. More specifically, image shifter 38 varies the position of display of image sub-frames 30, as described below, to produce displayed image 14.

In one embodiment, display device 26 includes a light modulator for modulation of incident light. The light modulator includes, for example, a plurality of micro-mirror devices arranged to form an array of micro-mirror devices. As such, each micro-mirror device constitutes one cell or pixel of display device 26. Display device 26 may form part of a display, projector, or other imaging system.

In one embodiment, image display system 10 includes a timing generator 40. Timing generator 40 communicates, for example, with frame rate conversion unit 20, image processing unit 24, including resolution adjustment unit 34 and sub-frame generation unit 36, and display device 26, including image shifter 38. As such, timing generator 40 synchronizes buffering and conversion of image data 16 to create image frame 28, processing of image frame 28 to adjust the resolution of image data 16 and generate image sub-frames 30, and positioning and displaying of image sub-frames 30 to produce displayed image 14. Accordingly, timing generator 40 controls timing of image display system 10 such that entire sub-frames of image 12 are temporally and spatially displayed by display device 26 as displayed image 14.

Figure 2C:
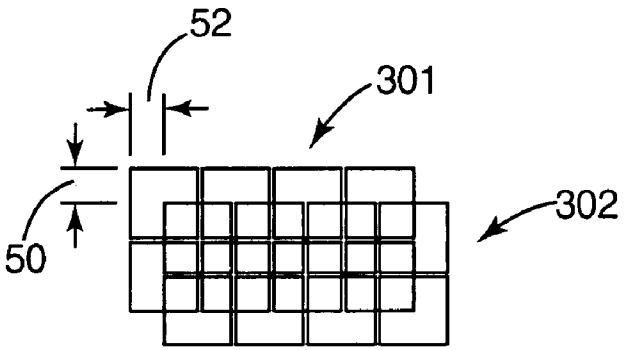
FIGS. 2A-2C are schematic diagrams illustrating the display of two sub-frames according to one embodiment of the present invention.
Figure 2B:
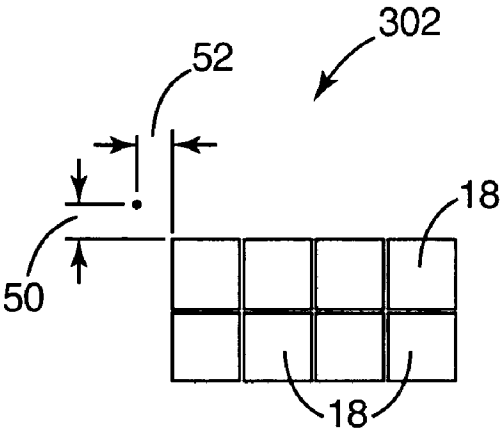
Figure 2A:
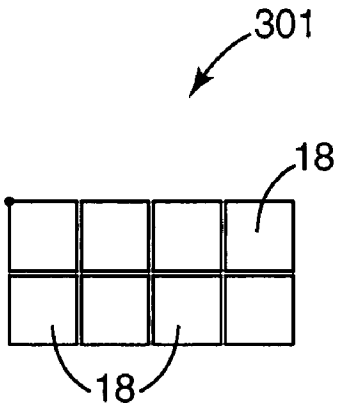

In one embodiment, as illustrated in FIGS. 2A and 2B, image processing unit 24 defines two image sub-frames 30 for image frame 28. More specifically, image processing unit 24 defines a first sub-frame 301 and a second sub-frame 302 for image frame 28. As such, first sub-frame 301 and second sub-frame 302 each include a plurality of columns and a plurality of rows of individual pixels 18 of image data 16. Thus, first sub-frame 301 and second sub-frame 302 each constitute an image data array or pixel matrix of a subset of image data 16.

In one embodiment, as illustrated in FIG. 2B, second sub-frame 302 is offset from first sub-frame 301 by a vertical distance 50 and a horizontal distance 52. As such, second sub-frame 302 is spatially offset from first sub-frame 301 by a predetermined distance. In one illustrative embodiment, vertical distance 50 and horizontal distance 52 are each approximately one-half of one pixel.

As illustrated in FIG. 2C, display device 26 alternates between displaying first sub-frame 301 in a first position and displaying second sub-frame 302 in a second position spatially offset from the first position. More specifically, display device 26 shifts display of second sub-frame 302 relative to display of first sub-frame 301 by vertical distance 50 and horizontal distance 52. As such, pixels of first sub-frame 301 overlap pixels of second sub-frame 302. In one embodiment, display device 26 performs one cycle of displaying first sub-frame 301 in the first position and displaying second sub-frame 302 in the second position for image frame 28. Thus, second sub-frame 302 is spatially and temporally displayed relative to first sub-frame 301. The display of two temporally and spatially shifted sub-frames in this manner is referred to herein as two-position processing.

In another embodiment, as illustrated in FIGS. 3A-3D, image processing unit 24 defines four image sub-frames 30 for image frame 28. More specifically, image processing unit 24 defines a first sub-frame 301, a second sub-frame 302, a third sub-frame 303, and a fourth sub-frame 304 for image frame 28. As such, first sub-frame 301, second sub-frame 302, third sub-frame 303, and fourth sub-frame 304 each include a plurality of columns and a plurality of rows of individual pixels 18 of image data 16.

Figure 3A:
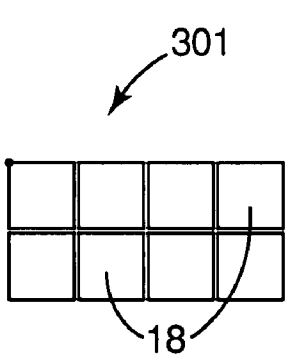
FIGS. 3A-3E are schematic diagrams illustrating the display of four sub-frames according to one embodiment of the present invention.
Figure 3B:
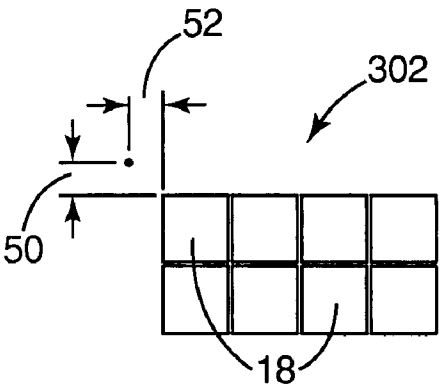
Figure 3C:
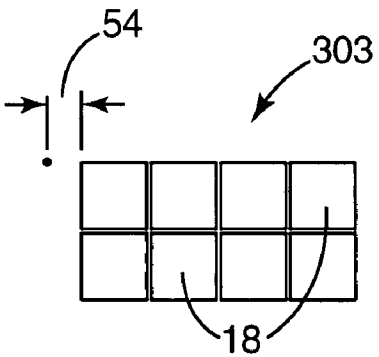
Figure 3D:
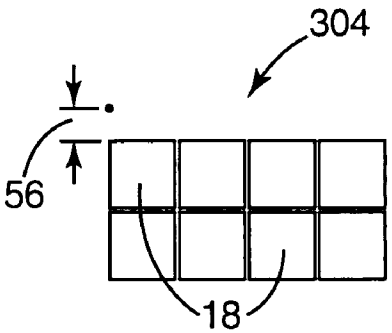

In one embodiment, as illustrated in FIGS. 3B-3D, second sub-frame 302 is offset from first sub-frame 301 by a vertical distance 50 and a horizontal distance 52, third sub-frame 303 is offset from first sub-frame 301 by a horizontal distance 54, and fourth sub-frame 304 is offset from first sub-frame 301 by a vertical distance 56. As such, second sub-frame 302, third sub-frame 303, and fourth sub-frame 304 are each spatially offset from each other and spatially offset from first sub-frame 301 by a predetermined distance. In one illustrative embodiment, vertical distance 50, horizontal distance 52, horizontal distance 54, and vertical distance 56 are each approximately one-half of one pixel.

Figure 3E:
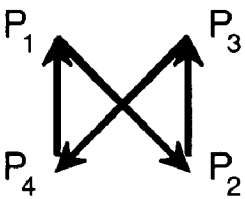

As illustrated schematically in FIG. 3E, display device 26 alternates between displaying first sub-frame 301 in a first position $P_1$, displaying second sub-frame 302 in a second position $P_2$ spatially offset from the first position, displaying third sub-frame 303 in a third position $P_3$ spatially offset from the first position, and displaying fourth sub-frame 304 in a fourth position $P_4$ spatially offset from the first position. More specifically, display device 26 shifts display of second sub-frame 302, third sub-frame 303, and fourth sub-frame 304 relative to first sub-frame 301 by the respective predetermined distance. As such, pixels of first sub-frame 301, second sub-frame 302, third sub-frame 303, and fourth sub-frame 304 overlap each other.

In one embodiment, display device 26 performs one cycle of displaying first sub-frame 301 in the first position, displaying second sub-frame 302 in the second position, displaying third sub-frame 303 in the third position, and displaying fourth sub-frame 304 in the fourth position for image frame 28. Thus, second sub-frame 302, third sub-frame 303, and fourth sub-frame 304 are spatially and temporally displayed relative to each other and relative to first sub-frame 301. The display of four temporally and spatially shifted sub-frames in this manner is referred to herein as four-position processing.

Figure 4A:
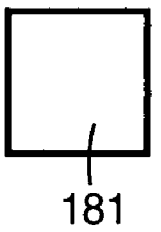
FIGS. 4A-4E are schematic diagrams illustrating the display of a pixel with an image display system according to one embodiment of the present invention.
Figure 4B:
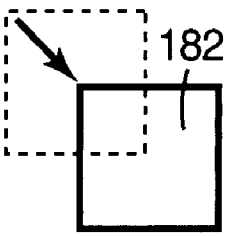
Figure 4C:
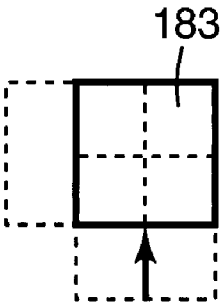
Figure 4D:
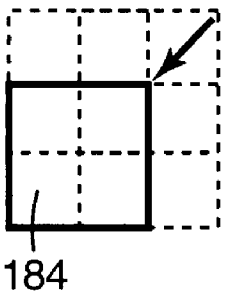
Figure 4E:
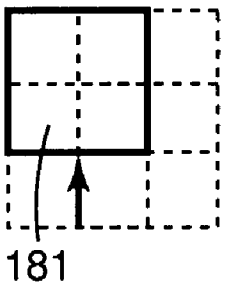

FIGS. 4A-4E illustrate one embodiment of completing one cycle of displaying a pixel 181 from first sub-frame 301 in the first position, displaying a pixel 182 from second sub-frame 302 in the second position, displaying a pixel 183 from third sub-frame 303 in the third position, and displaying a pixel 184 from fourth sub-frame 304 in the fourth position. More specifically, FIG. 4A illustrates display of pixel 181 from first sub-frame 301 in the first position, FIG. 4B illustrates display of pixel 182 from second sub-frame 302 in the second position (with the first position being illustrated by dashed lines), FIG. 4C illustrates display of pixel 183 from third sub-frame 303 in the third position (with the first position and the second position being illustrated by dashed lines), FIG. 4D illustrates display of pixel 184 from fourth sub-frame 304 in the fourth position (with the first position, the second position, and the third position being illustrated by dashed lines), and FIG. 4E illustrates display of pixel 181 from first sub-frame 301 in the first position (with the second position, the third position, and the fourth position being illustrated by dashed lines).

II. Error Hiding

In one embodiment, display device 26 includes a plurality of columns and a plurality of rows of display pixels. The display pixels modulate light to display image sub-frames 30 for image frame 28 and produce displayed image 14. One or more of the display pixels of display device 26 may be defective. A defective display pixel is defined to include an aberrant or inoperative display pixel of display device 26, such as a display pixel which exhibits only an "ON" or an "OFF" position, a display pixel which produces less intensity or more intensity than intended, or a display pixel with inconsistent or random operation. In one embodiment, when display device 26 displays a sub-frame 30, defective display pixels in display device 26 produce corresponding error pixels in the displayed sub-frame 30.

Figure 5:
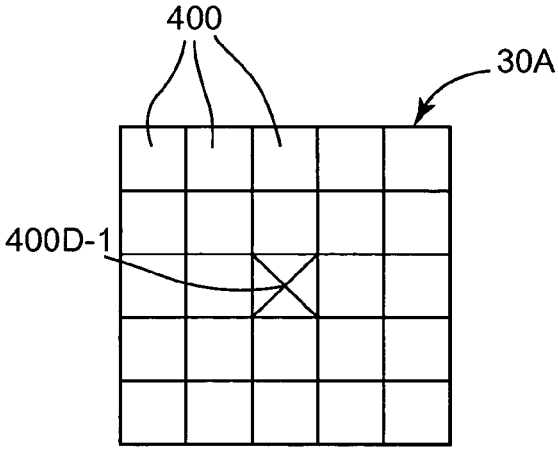
FIG. 5 is a diagram illustrating a sub-frame with an error pixel according to one embodiment of the present invention.

FIG. 5 is a diagram illustrating a sub-frame 30A with an error pixel 400D-1 according to one embodiment of the present invention. As shown in FIG. 5, sub-frame 30A includes a 5×5 array of pixels 400. Error pixel 400D-1, which is produced by a defective display pixel in display device 26, is positioned in the third column and the third row of sub-frame 30A. If the defective display pixel is stuck on, the error pixel 400D-1 will appear bright. If the defective display pixel is stuck off, the error pixel 400D-1 will appear dark.

In one embodiment, image display system 10 diffuses the effect of a defective display pixel or pixels of display device 26, thereby causing any error pixels in the displayed image 14 to be essentially hidden. As will be described in further detail below, image display system 10 according to one embodiment diffuses the effect of a defective display pixel or pixels of display device 26 by separating or dispersing areas of displayed image 14 which are produced by a defective display pixel of display device 26. One form of image display system 10 uses well-selected sub-frame positions that are spatially staggered not only within an individual frame 28, but across successive frames 28 as well, so that an error pixel appears for a very short time at a given spatial location in the displayed image 14. Thus, at any given spatial location, the error appears momentarily and is shifted to different locations in future sub-frames 30 and frames 28. This means that the "correct data" will be displayed most of the time (e.g., 15 sub-frames out of 16 sub-frames over 8 frames in one embodiment), so, on average, the presence of the error is hidden.

Figure 6:
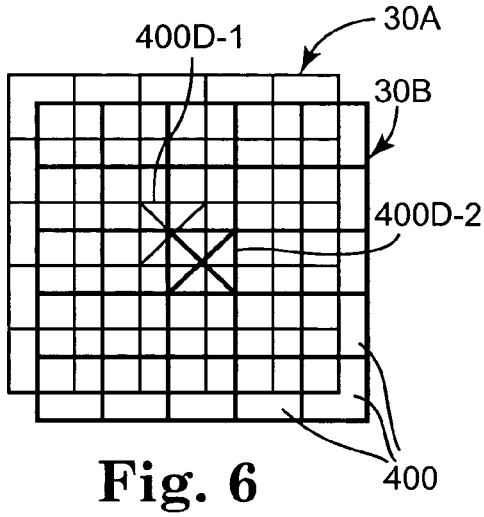
FIG. 6 is a diagram illustrating two sub-frames with error pixels and a half-pixel diagonal offset between the sub-frames according to one embodiment of the present invention.

FIG. 6 is a diagram illustrating two sub-frames 30A and 30B with error pixels 400D-1 and 400D-2 and a half-pixel diagonal offset (i.e., one-half pixel horizontal offset and one-half pixel vertical offset) between the sub-frames according to one embodiment of the present invention. As shown in FIG. 6, sub-frame 30A includes a 5×5 array of pixels 400, including error pixel 400D-1, which is produced by a defective display pixel in display device 26. Error pixel 400D-1 is positioned in the third column and the third row of sub-frame 30A. Sub-frame 30B also includes a 5×5 array of pixels 400, including error pixel 400D-2, which is produced by the same defective display pixel in display device 26. Error pixel 400D-2 is positioned in the third column and the third row of sub-frame 30B. By using a half-pixel diagonal offset between the sub-frames as shown in FIG. 6, the error pixel 400D-2 of sub-frame 30B partially overlaps the error pixel 400D-1 of sub-frame 30A. If sub-frames 30A and 30B are displayed in relatively quick succession using two-position processing, the error in the displayed image 14 will appear larger than either of the two individual error pixels 400D-1 or 400D-2. Thus, rather than hiding the error, the half-pixel diagonal offset shown in FIG. 6 tends to make the error in the displayed image 14 more pronounced.

Figure 7:
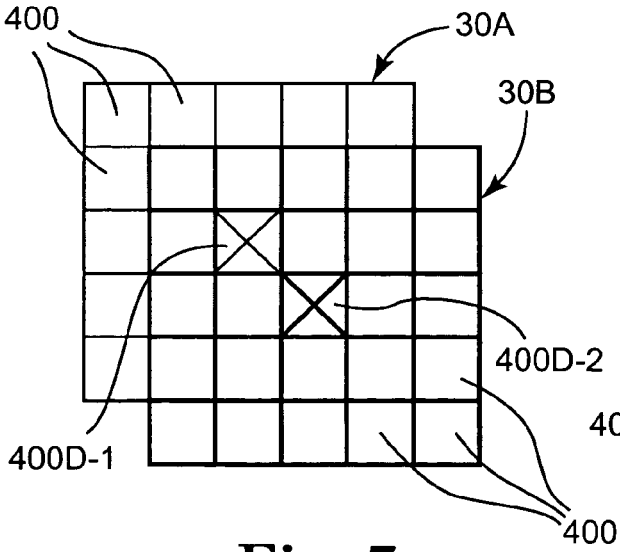
FIG. 7 is a diagram illustrating two sub-frames with error pixels and a one-pixel diagonal offset between the sub-frames according to one embodiment of the present invention.

FIG. 7 is a diagram illustrating two sub-frames 30A and 30B with error pixels 400D-1 and 400D-2 and a one-pixel diagonal offset (i.e., one pixel horizontal offset and one pixel vertical offset) between the sub-frames according to one embodiment of the present invention. The sub-frames 30A and 30B shown in FIG. 7 are the same as those shown in FIG. 6, but are offset in a diagonal direction by one full pixel, rather than a half-pixel offset as shown in FIG. 6. By using a one-pixel diagonal offset between the sub-frames as shown in FIG. 7, the error pixel 400D-2 of sub-frame 30B does not overlap the error pixel 400D-1 of sub-frame 30A. In addition, the error pixel 400D-1 of sub-frame 30A completely overlaps with a "good" pixel 400 from sub-frame 30B (i.e., the pixel 400 in the second row and second column of sub-frame 30B), and the error pixel 400D-2 of sub-frame 30B completely overlaps with a "good" pixel 400 from sub-frame 30A (i.e., the pixel 400 in the second row and second column of sub-frame 30A). If sub-frames 30A and 30B are displayed in relatively quick succession using two-position processing, the effect of the error pixels 400D-1 and 400D-2 is diffused, and the error is essentially hidden in the displayed image 14. In another embodiment, rather than using a one-pixel offset, other integer pixel offsets greater than one are used.

Using an integer pixel offset between sub-frames 30, such as shown in FIG. 7, provides error hiding capabilities as described above, but does not provide an appearance of increased resolution in the displayed image 14. Pixels 400 of sub-frame 30B completely overlap pixels 400 of sub-frame 30A, so no sub-pixels are created.

Figure 8:
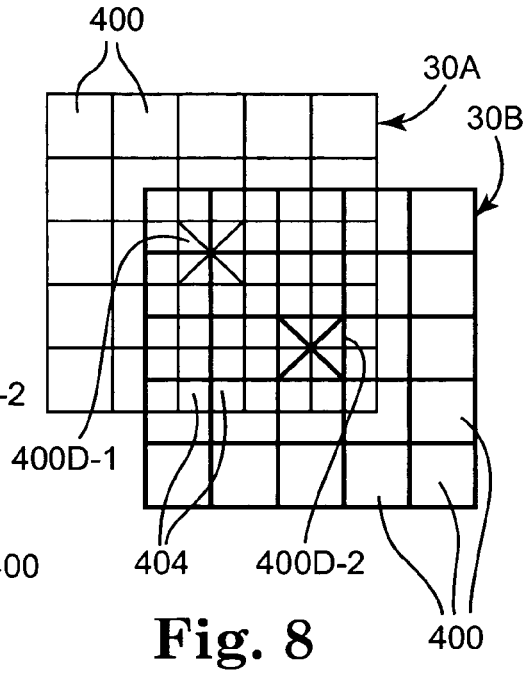
FIG. 8 is a diagram illustrating two sub-frames with error pixels and a 1.5 pixel diagonal offset between the sub-frames according to one embodiment of the present invention.

FIG. 8 is a diagram illustrating two sub-frames 30A and 30B with error pixels 400D-1 and 400D-2 and a 1.5 pixel diagonal offset (i.e., 1.5 pixel horizontal offset and 1.5 pixel vertical offset) between the sub-frames according to one embodiment of the present invention. The sub-frames 30A and 30B shown in FIG. 8 are the same as those shown in FIG. 7, but are offset in a diagonal direction by 1.5 pixels, rather than a one pixel offset as shown in FIG. 7. By using a 1.5 pixel diagonal offset between the sub-frames as shown in FIG. 8, the error pixel 400D-2 of sub-frame 30B does not overlap the error pixel 400D-1 of sub-frame 30A. In addition, the error pixel 400D-1 of sub-frame 30A completely overlaps with the corners of four "good" pixels 400 from sub-frame 30B, and the error pixel 400D-2 of sub-frame 30B completely overlaps with the corners of four "good" pixels 400 from sub-frame 30A. If sub-frames 30A and 30B are displayed in relatively quick succession using two-position processing, the effect of the error pixels 400D-1 and 400D-2 is diffused, and the error is essentially hidden in the displayed image 14. In another embodiment, rather than using a 1.5 pixel offset, an n-pixel offset is used between sub-frames 30, where "n" is a non-integer greater than one.

In addition to providing error hiding, the use of the 1.5 pixel offset (or other non-integer offset) gives the appearance to the human visual system of a higher resolution displayed image 14. With a non-integer offset, high-resolution sub-pixels 404 are formed from the superposition of the lower resolution pixels 400 from sub-frames 30A and 30B as shown in FIG. 8.

The embodiments of two-position processing and four-position processing described above involve intra-frame processing, meaning that the positions of the sub-frames 30 are varied within each frame 28, but the same positions are used from one frame 28 to the next frame 28. In other words, in one embodiment, the same two sub-frame positions (for two-position processing) are used for each frame 28, or the same four sub-frame positions (for four-position processing) are used for each frame 28.

Additional diffusion of error pixels can be provided by using more sub-frame positions for each frame 28. However, with intra-frame processing, the use of more positions per frame 28 results in a reduction in the number of bits per position, as will now be described in further detail.

In one form of the invention, image display system 10 (FIG. 1) uses pulse width modulation (PWM) to generate light pulses of varying widths that are integrated over time to produce varying gray tones, and image shifter 38 (FIG. 1) includes a discrete micro-mirror device (DMD) array to produce sub-pixel shifting of displayed sub-frames 30 during a frame time. In one embodiment, the time slot for one frame 28 (i.e., frame time or frame time slot) is divided among three colors (e.g., red, green, and blue) using a color wheel. The time slot available for a color per frame (i.e., color time slot) and the switching speed of the DMD array determines the number of levels, and hence the number of bits of grayscale, obtainable per color for each frame 28. With two-position processing and four-position processing, the time slots are further divided up into spatial positions of the DMD array. This means that the number of bits per position for two-position and four-position processing is less than the number of bits when such processing is not used. The greater the number of positions per frame, the greater the spatial resolution of the projected image. However, the greater the number of positions per frame, the smaller the number of bits per position, which can lead to contouring artifacts.

In another embodiment of the present invention, different sub-frame positions are used from one frame 28 to the next, which is referred to herein as inter-frame processing. For example, assuming that display device 26 provides eight allowable sub-frame positions and is configured to use two-position inter-frame processing, in one embodiment, a first set of two sub-frame positions is used for a first frame 28, a second set (different from the first set) of two sub-frame positions is used for the second frame 28, a third set (different from the first and second sets) of two sub-frame positions is used for the third frame 28, and a fourth set (different from the first, second, and third sets) of two sub-frame positions is used for the fourth frame 28. The four sets of two positions are then repeated for each subsequent set of four frames 28. Unlike intra-frame processing, by using inter-frame processing and varying the sub-frame positions from frame 28 to frame 28, an increased number of sub-frame positions is provided without the loss of bit depth associated with increasing the number of sub-frame positions for each frame 28. The increased number of sub-frame positions using inter-frame processing provides further diffusion of any error pixels in the displayed image 14.

As mentioned above, in one embodiment, a frame time slot is divided into a plurality of color time slots. For example, if two sub-frames 30 are used per frame 28, a frame time slot may include six color time slots (e.g., three color time slots per sub-frame 30). In one form of the invention, sub-frame positions are changed from one color time slot to the next to provide yet further diffusion of error pixels.

Different sequences of sub-frame positions have different effects on the human visual system. Some sequences of sub-frame positions are preferred over other sequences because they make defective pixels less noticeable to the human visual system. One form of the present invention provides a method of identifying a sequence of sub-frame positions that minimizes the impact of defective pixels on the human visual system. Given a number of allowable sub-frame positions and a set of known defective display pixels, one embodiment of the invention allocates a set of the allowable sub-frame positions across sub-frames 30 and across frames 28 to achieve an optimal displayed image 14 that minimizes the impact of defective display pixels. The selection of sub-frame positions that minimize the effect of defective display pixels according to one embodiment is described in further detail below with reference to FIGS. 9-14.

Figure 9:
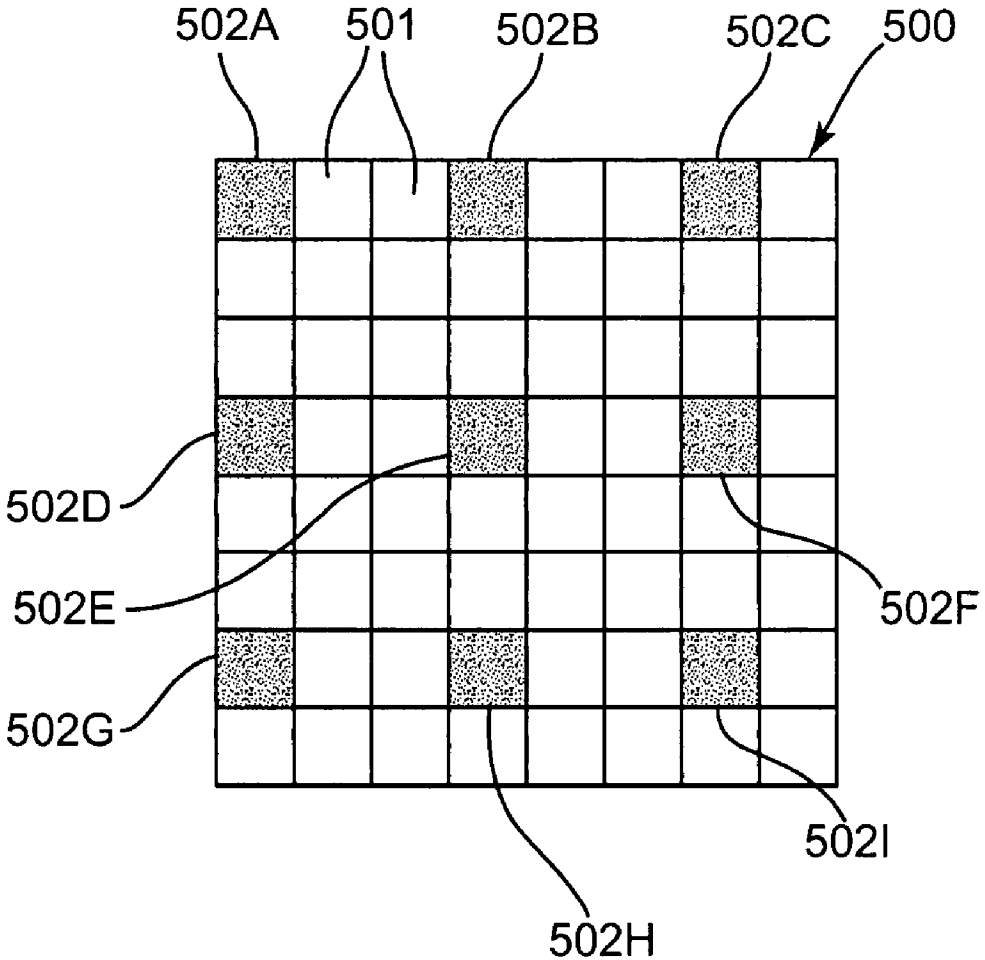
FIG. 9 is a diagram illustrating a high resolution grid with a set of allowable sub-frame positions according to one embodiment of the present invention.

FIG. 9 is a diagram illustrating a high resolution grid 500 with a set of allowable sub-frame positions 502A-5021 (collectively referred to as sub-frame positions 502) according to one embodiment of the present invention. In one embodiment, display device 26 is configured to display sub-frames 30 at selected ones of the nine sub-frame positions 502. Each sub-frame position 502 is identified in FIG. 9 by a single dark high resolution pixel on the high resolution grid 500. In one embodiment, the single high resolution pixel identifying a given sub-frame position 502 corresponds to the position of the upper left corner pixel of a sub-frame 30 that would be displayed at that position.

Figure 10C:
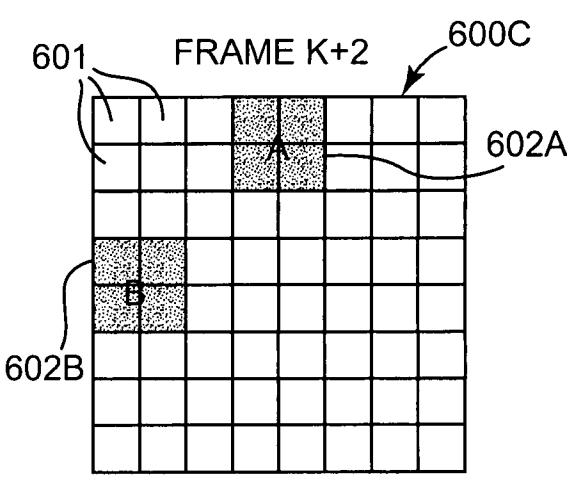
FIGS. 10A-10C are diagrams illustrating error images for three consecutive frames according to one embodiment of the present invention.
Figure 10B:
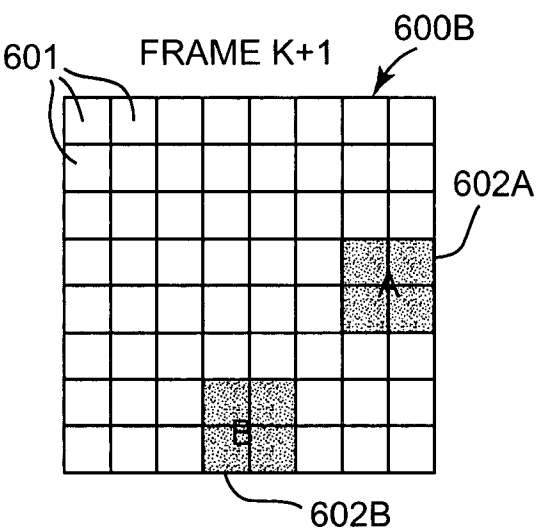
Figure 10A:
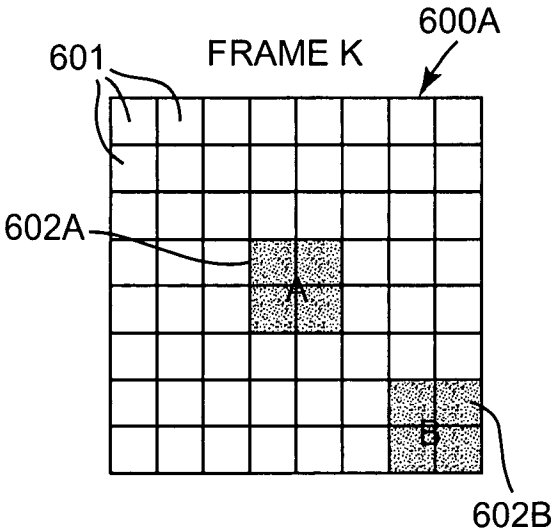

FIGS. 10A-10C are diagrams illustrating error images or test images 600A-600C (collectively referred to as error images 600) for three consecutive frames 28 according to one embodiment of the present invention. Each error image 600 includes a plurality of high resolution pixels 601. Each error image 600 represents the appearance to the human visual system of the display of two sub-frames 30 in relatively quick succession using two-position inter-frame processing. In the illustrated embodiment, each error image 600 includes only the image data corresponding to error pixels of the sub-frames 30, and not the other image data from the sub-frames 30. With two-position inter-frame processing, two sub-frame positions are used for each frame 28, but the same positions are not necessarily repeated across frames 28.

In the illustrated embodiment, it is assumed that display device 26 includes a single defective display pixel. The single defective display pixel of display device 26 produces a corresponding error pixel in each displayed sub-frame 30 with a position that depends on the position of the displayed sub-frame 30. The low resolution error pixel for each sub-frame 30 is mapped to a corresponding set of four high resolution error pixels in each error image 600. With two position processing, two sets of four high resolution error pixels are displayed for each frame 28, one set of four error pixels for each sub-frame 30. Error pixels 602A in FIGS. 10A-10C represent error pixels for a first sub-frame 30, and error pixels 602B in FIGS. 10A-10C represent error pixels for a second sub-frame 30.

Error image 600A (FIG. 10A) corresponds to a first frame 28 (frame k), and includes error pixels 602A corresponding to a first sub-frame 30 and mapped to position 502E (FIG. 9), and error pixels 602B corresponding to a second sub-frame 30 and mapped to position 5021 (FIG. 9). Error image 600B (FIG. 10B) corresponds to a second frame 28 (frame k+1), and includes error pixels 602A corresponding to a first sub-frame 30 and mapped to position 502F (FIG. 9), and error pixels 602B corresponding to a second sub-frame 30 and mapped to position 502H (FIG. 9). Error image 600C (FIG. 10C) corresponds to a third frame 28 (frame k+2), and includes error pixels 602A corresponding to a first sub-frame 30 and mapped to position 502B (FIG. 9), and error pixels 602B corresponding to a second sub-frame 30 and mapped to position 502D (FIG. 9).

In one embodiment, each error pixel in error images 600 is assigned a value between 0 and 1. In one form of the invention, each error pixel corresponding to a display pixel that is stuck on is assigned a first value (e.g., 1), and each error pixel corresponding to a display pixel that is stuck off is assigned a second value (e.g., 0). In another embodiment, error pixels corresponding to stuck on or stuck off display pixels are assigned the same value (e.g., 0.5). The set of error images 600 shown in FIGS. 10A-10C represents a spatio-temporal error pattern that can be evaluated to determine its effect on the human visual system. In one embodiment, sub-frame positions are chosen to minimize the impact of the spatio-temporal error pattern on the human visual system, as described in further detail below with reference to FIGS. 11-14.

Figure 11:
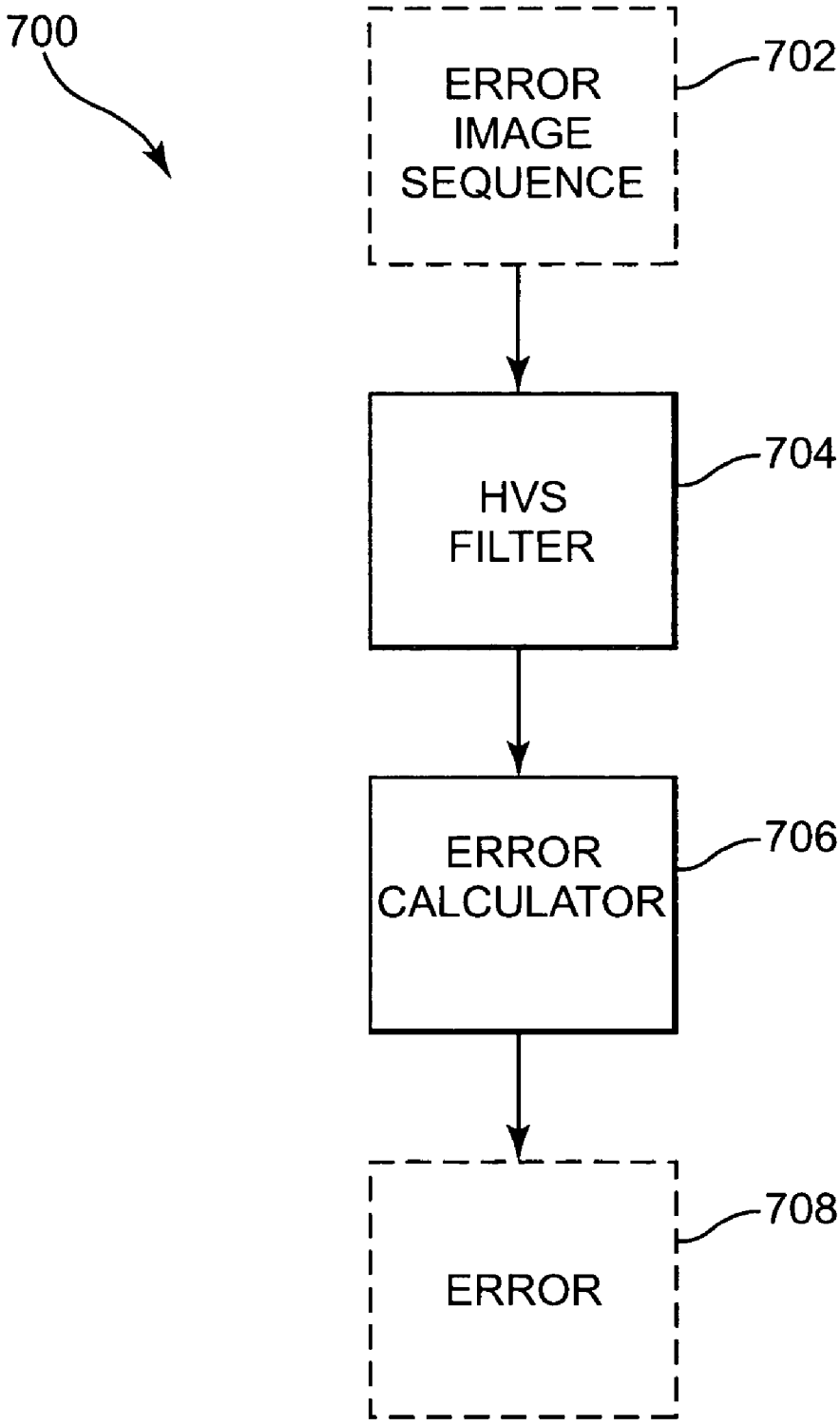
FIG. 11 is a block diagram illustrating an error calculation system according to one embodiment of the present invention.

FIG. 11 is a block diagram illustrating an error calculation system 700 according to one embodiment of the present invention. In one embodiment, error calculation system 700 is a part of image processing unit 24 (FIG. 1). Error calculation system 700 includes human visual system (HVS) spatio-temporal filter 704 and error calculator 706. In one embodiment, HVS filter 704 is a linear shift invariant filter. In one form of the invention, HVS filter 704 is based on a spatio-temporal contrast sensitivity function (CSF), such as that described in D. H. Kelly, "Motion and Vision—II. Stabilized Spatio-Temporal Threshold Surface," Journal of the Optical Society of America, Vol. 69, No. 10, October 1979, which is hereby incorporated by reference herein. HVS filter 704 receives an error image sequence 702. In one embodiment, error image sequence 702 includes a set of error images 600, which are described above with reference to FIG. 10. HVS filter 704 filters the received error image sequence 702 and thereby generates a weighted error image sequence that is output to error calculator 706. Based on the weighted error image sequence received from HVS filter 704, error calculator calculates an error value or metric 708, which is a value indicating the magnitude of the impact of the current error image sequence 702 on the human visual system. If error value 708 is large, this indicates that the current error image sequence 702 has a large impact on the human visual system. If error value 708 is small, this indicates that the current error image sequence 702 has a small impact on the human visual system.

In one embodiment, error calculation system 700 is used to evaluate different sub-frame positions in error image sequence 702, and identify the sub-frame positions that minimize the error value 708, and correspondingly minimize the impact of error pixels on the human visual system. Assuming that there are a total of N sub-frame positions to be allocated, with M sub-frame positions per frame 28, and that the pattern of sub-frame positions repeats every T frames, with no sub-frame position being allocated more than once every T frames, the total number of possible combinations of sub-frame positions can become quite large, depending upon the chosen values for N, M, and T. Thus, it is desirable to use efficient algorithms to identify appropriate sub-frame positions. In one embodiment, sub-frame positions are selected using an "exhaustive enumeration" algorithm, which is described below with reference to FIG. 12. In another embodiment, sub-frame positions are selected using a "sequential" algorithm, which is described below with reference to FIG. 13. In yet another embodiment, sub-frame positions are selected using a "heuristic search" algorithm, which is described below with reference to FIG. 14. In one form of the invention, image processing unit 24 (FIG. 10) is configured to perform one or more of the algorithms illustrated in FIGS. 12-14.

Figure 12:
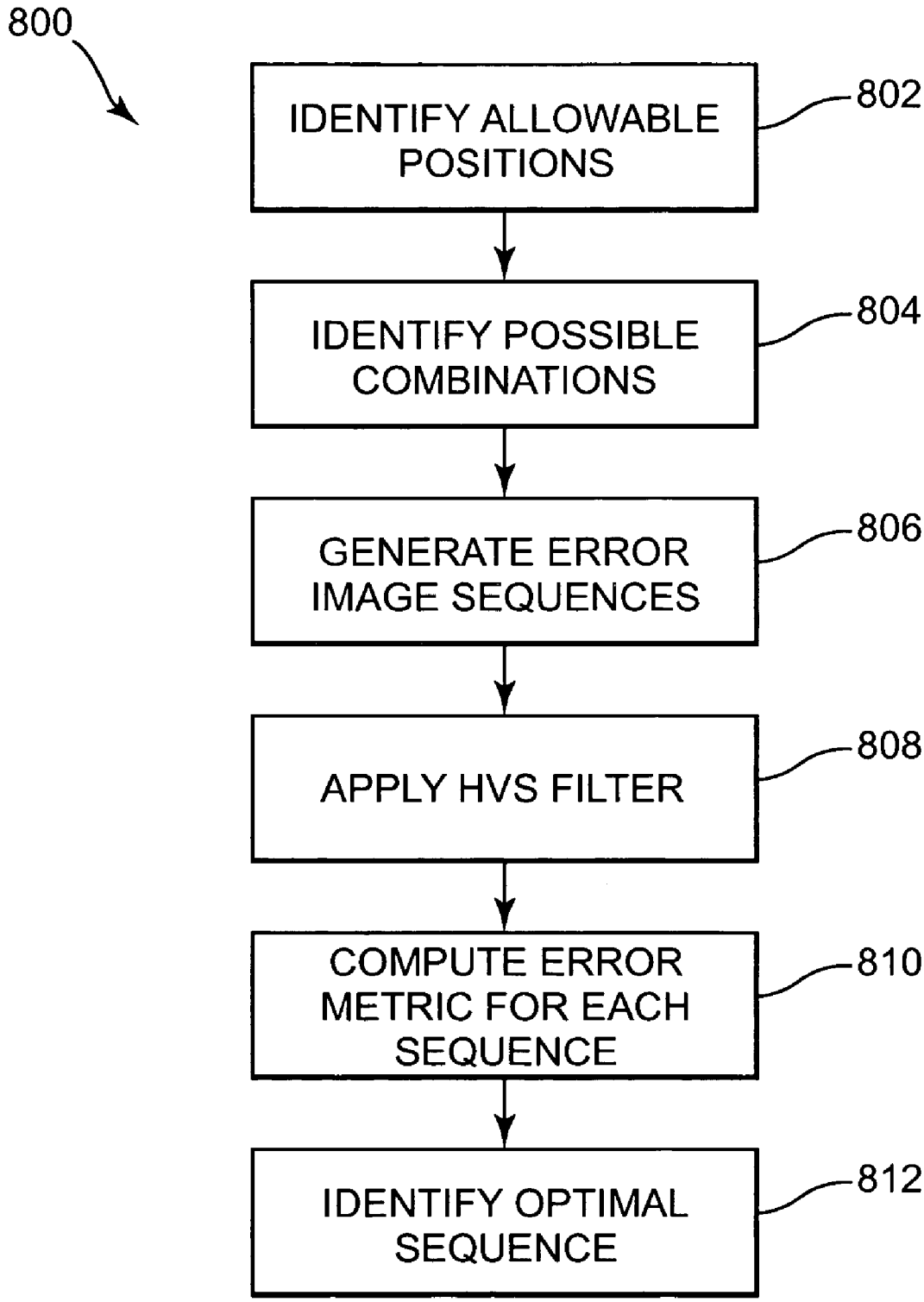
FIG. 12 is a flow diagram illustrating an "exhaustive enumeration" algorithm for identifying a sequence of sub-frame positions according to one embodiment of the present invention.

FIG. 12 is a flow diagram illustrating an "exhaustive enumeration" algorithm 800 for identifying a sequence of sub-frame positions according to one embodiment of the present invention. In step 802, the allowable sub-frame positions to be allocated are identified. In one embodiment, display device 26 is configured to provide eight different sub-frame positions. In another embodiment, display device 26 is configured to provide more or less than eight different sub-frame positions. In step 804, the possible combinations of M sub-frame positions per frame 28 over T frames 28 are identified. In one embodiment, M=2 and T=4, so the possible combinations of eight sub-frame positions are identified (i.e., two sub-frame positions per frame 28 over four frames 28). In another embodiment, other values are used for M and T.

In step 806, a plurality of error image sequences 702 (FIG. 11) are generated. In one embodiment, one error image sequence 702 is generated for each combination of sub-frame positions identified in step 804, with each error image sequence 702 including T error images 600 (FIGS. 10A-10C). In step 808, a human visual system filter 704 (FIG. 11) is applied to each error image sequence 702 generated in step 806, thereby generating a plurality of weighted error image sequences. In step 810, an error metric 708 (FIG. 11) is computed by error calculator 706 for each of the weighted error image sequences generated in step 808. In step 812, an optimal weighted error image sequence is identified. In one embodiment, the optimal weighted error image sequence is the sequence generated in step 808 with the smallest error metric 708 computed in step 810. The sub-frame positions corresponding to the optimal weighted error image sequence represent the optimal sub-frame positions for reducing the effects of defective display pixels of display device 26. In one form of the invention, the exhaustive enumeration algorithm 800 is used when the set of allowable sub-frame positions is relatively small.

Figure 13:
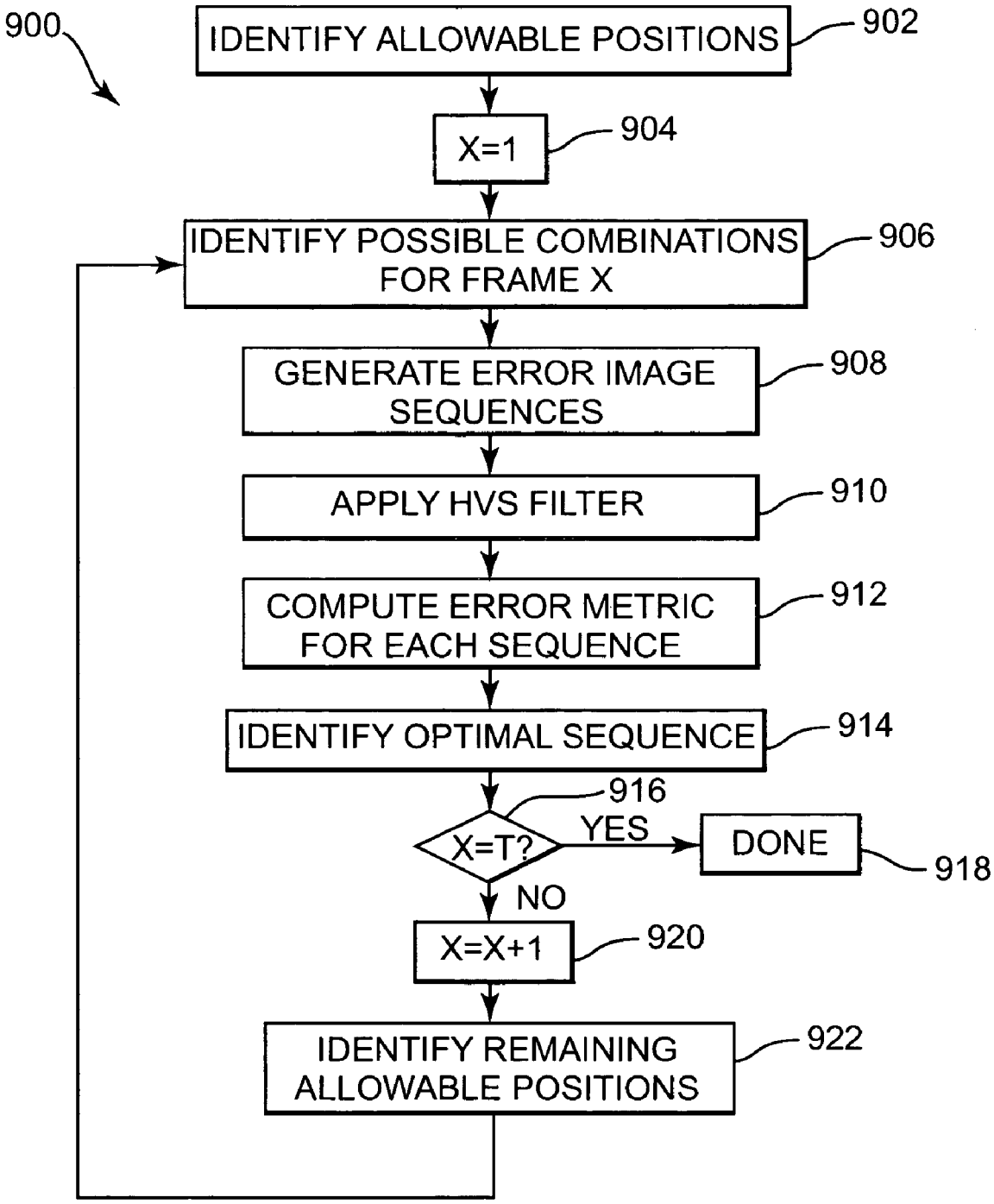
FIG. 13 is a flow diagram illustrating a "sequential" algorithm for identifying a sequence of sub-frame positions according to one embodiment of the present invention.

FIG. 13 is a flow diagram illustrating a "sequential" algorithm 900 for identifying a sequence of sub-frame positions according to one embodiment of the present invention. The sequential algorithm 900 according to one embodiment is used to allocate sub-frame positions for one frame 28 at a time using a sequential decision process. In step 902, the allowable sub-frame positions to be allocated are identified. In one embodiment, display device 26 is configured to provide eight different sub-frame positions. In another embodiment, display device 26 is configured to provide more or less than eight different sub-frame positions. In step 904, a frame counter variable "x" is initialized to the value "1". In step 906, the possible combinations of M sub-frame positions for "frame x" are identified. Since "x" was set to the value "1" in step 904, the possible combinations of M sub-frame positions for the first frame 28 (or frame 1) in a sequence of T frames 28 are identified. In one embodiment, M=2 and T=4, and the possible combinations of two sub-frame positions are identified for the first frame 28 during the first execution of step 906. In another embodiment, other values are used for M and T.

In step 908, a plurality of error image sequences 702 (FIG. 11) are generated. In one embodiment, one error image sequence 702 is generated for each combination of sub-frame positions identified in step 906, with each error image sequence 702 including T error images 600 (FIGS. 10A-10C). In one form of the invention, during the first pass through the sequential algorithm 900, for each of the error image sequences 702, the error image 600 corresponding to the first frame (frame 1) is repeated for the remaining T−1 frames. Thus, during the first pass through the sequential algorithm 900, all of the error images 600 for a given error image sequence 702 will be the same.

In step 910, a human visual system filter 704 (FIG. 11) is applied to each error image sequence 702 generated in step 908, thereby generating a plurality of weighted error image sequences. In step 912, an error metric 708 (FIG. 11) is computed by error calculator 706 for each of the weighted error image sequences generated in step 910. In step 914, an optimal weighted error image sequence is identified. In one embodiment, the optimal weighted error image sequence is the sequence generated in step 910 with the smallest error metric 708 computed in step 912. The sub-frame positions corresponding to the first frame or first error image 600 of the optimal weighted error image sequence represent the optimal sub-frame positions for the first frame 28 of T frames 28 for reducing the effects of defective display pixels of display device 26.

In step 916, it is determined whether the frame counter variable "x" is equal to the variable "T", which identifies the number of frames 28 in the sequence. If the value for "x" is equal to the value for "T", than the algorithm 900 moves to step 918, which indicates that the algorithm 900 is done. If the value for "x" is not equal to the value for "T", than the algorithm 900 moves to step 920. In step 920, the frame counter variable "x" is incremented by one. Since "x" was set to "1" in step 904, the value for "x" becomes "2" after step 920.

In step 922, the remaining allowable sub-frame positions to be allocated are identified. In one embodiment, there are eight allowable sub-frame positions that are allocated over four (T=4) frames 28 at a time, with two (M=2) sub-frame positions allocated to each frame 28. In this embodiment, after the first pass through sequential algorithm 900, the sub-frame positions for the first frame 28 are allocated, which leaves six sub-frame positions remaining to be allocated. After identifying the remaining allowable sub-frame positions in step 922, the algorithm 900 returns to step 906.

During the second pass through algorithm 900, it is assumed that the sub-frame positions for the first frame 28 are set, and the algorithm 900 identifies the best sub-frame positions for the second frame 28 in the sequence of T frames 28. In step 906, the possible combinations of M sub-frame positions for the second frame 28 (frame 2) are identified. In step 908, a plurality of error image sequences 702 (FIG. 11) are generated. In one embodiment, one error image sequence 702 is generated for each combination of sub-frame positions identified in step 906, with each error image sequence 702 including T error images 600 (FIGS. 10A-10C). In one form of the invention, during the second pass through the sequential algorithm 900, for each of the error image sequences 702, the error images 600 corresponding to the first two frames 28 are repeated for the remaining T−2 frames in the sequence.

In step 910 of the second pass through the sequential algorithm 900, the human visual system filter 704 is applied to each error image sequence 702 generated in step 908, thereby generating a plurality of weighted error image sequences. In step 912, an error metric 708 is computed by error calculator 706 for each of the weighted error image sequences generated in step 910. In step 914, an optimal weighted error image sequence is identified. In one embodiment, the optimal weighted error image sequence is the sequence generated in step 910 with the smallest error metric 708 computed in step 912. The sub-frame positions corresponding to the second frame or second error image 600 of the optimal weighted error image sequence represent the optimal sub-frame positions for the second frame 28 of T frames 28 for reducing the effects of defective display pixels of display device 26.

In step 916 of the second pass through the sequential algorithm 900, it is determined whether the frame counter variable "x" is equal to the variable "T", which identifies the number of frames 28 in the sequence. If the value for "x" is equal to the value for "T", than the algorithm 900 moves to step 918, which indicates that the algorithm 900 is done. If the value for "x" is not equal to the value for "T", than the algorithm 900 moves to step 920. In step 920, the frame counter variable "x" is incremented by one, thereby changing the value of "x" to 3.

In step 922 of the second pass through the sequential algorithm 900, the remaining allowable sub-frame positions to be allocated are identified. In one embodiment, there are eight allowable sub-frame positions that are allocated over four (T=4) frames 28 at a time, with two (M=2) sub-frame positions allocated to each frame 28. After the second pass through sequential algorithm 900, the sub-frame positions for the first two frames have been allocated, which leaves four sub-frame positions remaining to be allocated. After identifying the remaining allowable sub-frame positions in step 922, the algorithm 900 returns to step 906. During each subsequent pass through sequential algorithm 900, the sub-frame positions for the next consecutive frame 28 in a sequence of T frames 28 are allocated. The number of iterations that are performed depends upon the number of frames T in a given sequence.

Algorithm 900 according to one embodiment provides locally optimum solutions by sequentially identifying optimum sub-frame positions one frame 28 at a time in a sequence of T frames 28, and assuming that previously allocated sub-frame positions in the sequence are set, and not used by subsequently analyzed frames 28 in the sequence. In contrast, algorithm 1000 according to one embodiment, which is described below with reference to FIG. 14, provides a globally optimum solution.

Figure 14:
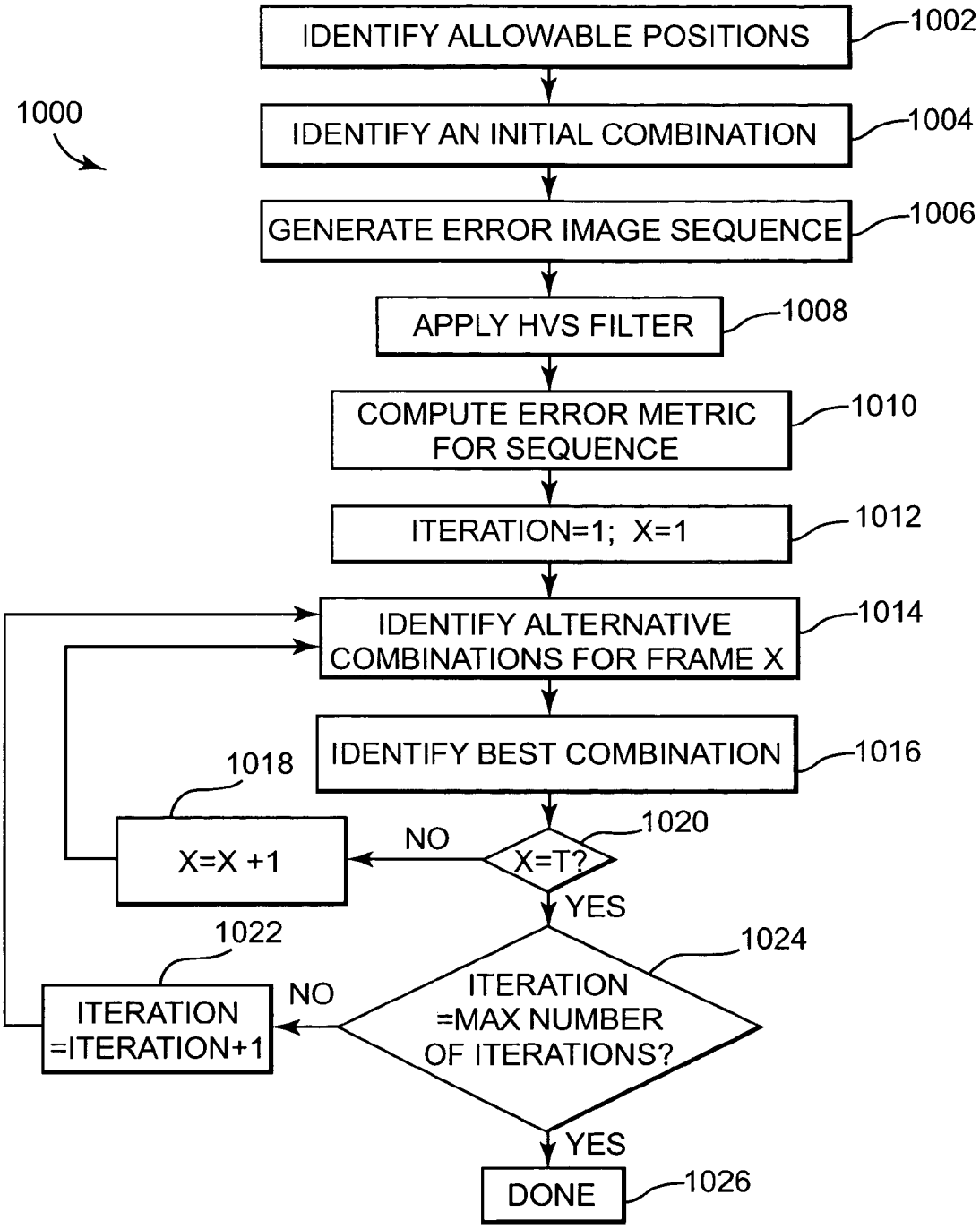
FIG. 14 is a flow diagram illustrating a "heuristic search" algorithm for identifying a sequence of sub-frame positions according to one embodiment of the present invention.

FIG. 14 is a flow diagram illustrating a "heuristic search" algorithm 1000 for identifying a sequence of sub-frame positions according to one embodiment of the present invention. In step 1002, the allowable sub-frame positions to be allocated are identified. In one embodiment, display device 26 is configured to provide eight different sub-frame positions. In another embodiment, display device 26 is configured to provide more or less than eight different sub-frame positions. In step 1004, an initial combination of M sub-frame positions per frame 28 over T frames 28 is identified. In one embodiment, M=2 and T=4, so an initial combination of eight sub-frame positions are identified (i.e., two sub-frame positions per frame 28 over four frames 28). In another embodiment, other values are used for M and T.

In step 1006, an error image sequence 702 (FIG. 11) is generated based on the initial combination of sub-frame positions identified in step 1004, with the error image sequence 702 including T error images 600 (FIGS. 10A-10C). In step 1008, a human visual system filter 704 (FIG. 11) is applied to the error image sequence 702 generated in step 1006, thereby generating a corresponding weighted error image sequence. In step 1010, an error metric 708 (FIG. 11) is computed by error calculator 706 for the weighted error image sequence generated in step 1008. In step 1012, the frame counter variable "x" and the iteration counter variable "Iteration" are each initialized to the value "1".

In step 1014, alternative combinations of M sub-frame positions are identified for "frame x". Since "x" was set to the value "1" in step 1012, alternative combinations of M sub-frame positions for the first frame 28 (or frame 1) in a sequence of T frames 28 are identified. In one embodiment, the identification of alternative combinations in step 1014 includes swapping one or more sub-frame positions allocated to the first frame 28 with sub-frame positions allocated to one or more of the other frames 28 in the sequence of T frames 28.

In one form of the invention, the identification of alternative combinations in step 1014 includes swapping one or more sub-frame positions allocated to the first frame 28 with new sub-frame positions that have not been allocated to any of the frames 28 in the sequence of T frames 28.

In step 1016, the alternative combinations of sub-frame positions are evaluated and the best combination of sub-frame positions is identified. In one embodiment, the best combination of sub-frame positions is the combination that reduces the error metric 708 (computed in step 1010) the most. If none of the alternative combinations of sub-frame positions results in a lower error metric 708, it is assumed that the initial combination of sub-frame positions is the current best combination.

In step 1020, it is determined whether the frame counter variable "x" is equal to the variable "T", which identifies the number of frames 28 in the sequence. If the value for "x" is not equal to the value for "T", than the algorithm 1000 moves to step 1018. In step 1018, the frame counter variable "x" is incremented by one, and the algorithm 1000 returns to step 1014. Since "x" was set to "1" in step 1012, the value for "x" becomes "2" after step 1018. If it is determined in step 1020 that the value for "x" is equal to the value for "T", than the algorithm 1000 moves to step 1024.

In step 1024, it is determined whether the iteration counter variable "Iteration" is equal to the variable "Max Number of Iterations", which is a termination criteria that identifies the desired number of iterations of algorithm 1000 to be executed. If it is determined in step 1024 that the value for "Iteration" is equal to the value for "Max Number of Iterations", than the algorithm 1000 moves to step 1026, which indicates that the algorithm 1000 is done. If the value for "Iteration" is not equal to the value for "Max Number of Iteration", than the algorithm 1000 moves to step 1022. In step 1022, the iteration counter variable "Iteration" is incremented by one, and the algorithm 1000 returns to step 1014. Since "Iteration" was set to "1" in step 1012, the value for "Iteration" becomes "2" after step 1022.

In one embodiment, there are eight allowable sub-frame positions that are allocated over four (T=4) frames 28 at a time, with two (M=2) positions allocated to each frame 28. After the first pass through algorithm 1000, sub-frame positions for all four frames 28 are initially allocated. Alternative sub-frame positions for the first frame 28 (including, in one embodiment, swaps with sub-frame positions allocated to other frames 28 or with sub-frame positions not currently allocated to any of the frames 28 in the sequence) are then evaluated to determine if there is a better combination of sub-frame positions than the initial allocation. During the second, third, and fourth, passes through algorithm 1000, alternative sub-frame positions for the second, third, and fourth frames 28, respectively, are evaluated (including, in one embodiment, swaps with sub-frame positions allocated to other frames 28, or with sub-frame positions not currently allocated to any of the frames 28 in the sequence) in an attempt to identify increasingly better combinations of sub-frame positions. Completion of the fourth pass through algorithm 1000 in this embodiment represents one iteration. Additional iterations may be performed to identify increasingly better combinations of sub-frame positions until the termination criteria has been satisfied.

One form of the present invention compensates for defective display pixels in display device 26. In one embodiment, the display pixels are DMD pixels in a digital light projector (DLP) display. One embodiment of the invention allows DMD arrays with a number of defective pixels to still be used effectively, rather than having to discard such arrays as has been done in the past. Defective display pixels of display device 26 may be identified by user input, self-diagnostic input or sensing by display device 26, an external data source, or information stored in display device 26. In one embodiment, information regarding defective display pixels is communicated between display device 26 and image processing unit 24.

Although specific embodiments have been illustrated and described herein for purposes of description of the preferred embodiment, it will be appreciated by those of ordinary skill in the art that a wide variety of alternate or equivalent implementations may be substituted for the specific embodiments shown and described without departing from the scope of the present invention. Those with skill in the mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A method of displaying an image with a display device having a set of defective display pixels, the method comprising:

receiving image data for the image;

generating a first sub-frame and a second sub-frame corresponding to the image data; and selecting a first position and a second position spatially offset from the first position, the first and the second positions selected based on positions of the defective display pixels and characteristics of a human visual system; and alternating between displaying the first sub-frame in the first position and displaying the second sub-frame in the second position.

2. The method of claim 1, and further comprising:

generating a third sub-frame and a fourth sub-frame corresponding to the image data;

selecting a third position spatially offset from the first position and the second position, and a fourth position spatially offset from the first position, the second position, and the third position, the third and the fourth positions selected based on positions of the defective display pixels and characteristics of a human visual system; and wherein alternating between displaying the first sub-frame and displaying the second sub-frame further includes alternating between displaying the first sub-frame in the first position, displaying the second sub-frame in the second position, displaying the third sub-frame in the third position, and displaying the fourth sub-frame in the fourth position.

3. The method of claim 1, and further comprising:

receiving a second set of image data for a second image;

generating a third sub-frame and a fourth sub-frame corresponding to the second set of image data;

selecting a third position and a fourth position spatially offset from the third position, the third and the fourth positions selected based on positions of the defective display pixels and characteristics of a human visual system; and alternating between displaying the third sub-frame in the third position and displaying the fourth sub-frame in the fourth position.

4. The method of claim 3, wherein the third position is spatially offset from the first position and the second position, and wherein the fourth position is spatially offset from the first position, the second position, and the third position.

5. The method of claim 1, wherein the first position and the second position are selected from a plurality of allowable positions.

6. The method of claim 5, and further comprising:

evaluating different combinations of the plurality of allowable positions to identify a combination that minimizes an effect of the defective display pixels on the human visual system.

7. The method of claim 5, and further comprising:

generating a plurality of sequences of test images, each sequence of test images corresponding to a different combination of the plurality of allowable positions.

8. The method of claim 7, and further comprising:

filtering each sequence of test images with a spatio-temporal filter based on human visual system (HVS) characteristics.

9. The method of claim 8, and further comprising:

identifying a sequence of test images from the plurality of sequences of test images that has the smallest impact on the human visual system.

10. The method of claim 9, wherein the first position and the second position are positions corresponding to the identified sequence of test images.

11. A system for displaying an image, the system comprising:

a buffer adapted to receive a first set of image data for a first image;

an image processing unit configured to define first and second sub-frames corresponding to the first set of image data; and a display device having a set of defective display pixels, the display device adapted to alternately display the first sub-frame in a first position and the second sub-frame in a second position spatially offset from the first position, wherein the first position and the second position are identified based on positions of the defective display pixels and spatio-temporal characteristics of a human visual system.

12. The system of claim 11, wherein the image processing unit is configured to define a third sub-frame and a fourth sub-frame corresponding to the first set of image data; and wherein the display device is configured to alternate between displaying the first sub-frame in the first position, displaying the second sub-frame in the second position, displaying the third sub-frame in a third position spatially offset from the first position and the second position, and displaying the fourth sub-frame in a fourth position spatially offset from the first position, the second position, and the third position, the third and the fourth positions identified based on positions of the defective display pixels and spatio-temporal characteristics of a human visual system.

13. The system of claim 11, wherein the buffer is adapted to receive a second set of image data for a second image, the image processing unit is configured to define a third sub-frame and a fourth sub-frame corresponding to the second set of image data, and the display device is configured to alternate between displaying the third sub-frame in a third position and displaying the fourth sub-frame in a fourth position, the third position and the fourth position identified based on positions of the defective display pixels and spatio-temporal characteristics of a human visual system.

14. The system of claim 13, wherein the third position is spatially offset from the first position and the second position, and wherein the fourth position is spatially offset from the first position, the second position, and the third position.

15. The system of claim 11, wherein the first position and the second position are identified from a plurality of allowable positions.

16. The system of claim 15, wherein the image processing unit is configured to evaluate different combinations of the plurality of allowable positions to identify a combination that minimizes an effect of the defective display pixels on the human visual system.

17. The system of claim 15, wherein the image processing unit is configured to generate a plurality of sequences of test images, each sequence of test images corresponding to a different combination of the plurality of allowable positions.

18. The system of claim 17, wherein the image processing unit is configured to filter each sequence of test images with a spatio-temporal filter based on human visual system (HVS) characteristics.

19. The system of claim 18, wherein the image processing unit is configured to identify a sequence of test images from the plurality of sequences of test images that has the smallest impact on the human visual system.

20. The system of claim 19, wherein the first position and the second position are positions corresponding to the identified sequence of test images.

21. A system for displaying low resolution sub-frames at spatially offset positions to generate the appearance of a high resolution image, the system comprising:

means for receiving high resolution images;

means for generating a plurality of low resolution sub-frames for each high resolution image;

means for displaying the plurality of low resolution sub-frames at a sequence of spatially offset positions, the means for displaying including at least one defective display pixel; and means for identifying the sequence of spatially offset positions based on a position of the defective display pixel and characteristics of a human visual system to minimize an impact of the defective display pixel on the human visual system.

22. The system of claim 21, wherein the sequence of spatially offset positions is selected from a plurality of allowable positions.

23. The system of claim 22, wherein the means for identifying includes means for evaluating different combinations of the plurality of allowable positions to identify a combination that minimizes an impact of the defective display pixel on the human visual system.

24. The system of claim 22, wherein the means for identifying includes means for generating a plurality of sequences of test images, each sequence of test images corresponding to a different combination of the plurality of allowable positions.

25. The system of claim 24, wherein the means for identifying includes means for filtering each sequence of test images with a spatio-temporal filter based on human visual system (HVS) characteristics.

26. The system of claim 25, wherein the means for identifying includes means for identifying a sequence of test images from the plurality of sequences of test images that has the smallest impact on the human visual system.

27. The system of claim 26, wherein the identified sequence of spatially offset positions comprises positions corresponding to the identified sequence of test images.

28. A computer-readable medium having computer-executable instructions for performing a method of identifying spatially offset display positions far low resolution sub-frames, the sub-frames generating the appearance of a high resolution image when displayed by a display device at the identified positions, comprising:

identifying a plurality of different combinations of the display positions; and analyzing each of the combinations to identify a combination of display positions that minimizes an effect of defective display pixels of the display device on a human visual system.

29. The computer-readable medium of claim 28, wherein the method further comprises:

generating a plurality of sequences of test images, each sequence of test images corresponding to a different combination of display positions.

30. The computer-readable medium of claim 29, wherein the method further comprises:

filtering each sequence of test images with a filter based on human visual system (HVS) spatio-temporal characteristics.

31. The computer-readable medium of claim 30, wherein the method further comprises:

identifying a sequence of test images from the plurality of sequences of test images that has the smallest impact on the human visual system.

32. The computer-readable medium of claim 31, wherein the identified combination of display positions comprises positions corresponding to the identified sequence of test images.

* * * * *

UNITED STATES PATENT AND TRADEMARK OFFICE

CERTIFICATE OF CORRECTION

PATENT NO. : 7,355,612 B2
APPLICATION NO. : 10/750591
DATED : April 8, 2008
INVENTOR(S) : Niranjan Damera-Venkata et al.

It is certified that error appears in the above-identified patent and that said Letters Patent is hereby corrected as shown below:

In column 19, line 30, in Claim 28, delete “far” and insert -- for --, therefor.

Signed and Sealed this

Twelfth Day of August, 2008

JON W. DUDAS
*Director of the United States Patent and Trademark Office*